US005916037A

United States Patent [19]

Hill

[11] Patent Number: 5,916,037

[45] Date of Patent: Jun. 29, 1999

[54] GOLF SWING TRAINING DEVICE AND METHOD

[76] Inventor: Gaius Hill, 7212 River Junction, Nashville, Tenn. 37721

[21] Appl. No.: 09/151,541

[22] Filed: Sep. 11, 1998

[51] Int. Cl.[6] ..... A63B 69/36

[52] U.S. Cl. ..... 473/277; 473/271; 473/452; 473/409

[58] Field of Search ..... 473/277, 271, 473/452, 409

[56] References Cited

U.S. PATENT DOCUMENTS

| | | | |
|---|---|---|---|
| 5,203,569 | 4/1993 | Rilling | 473/277 |
| 5,288,074 | 2/1994 | Scheurer | 473/277 |
| 5,591,090 | 1/1997 | Kauffman | 473/271 |
| 5,613,677 | 3/1997 | Walker | 473/452 |
| 5,672,115 | 9/1997 | Sanchez et al. | 473/216 |
| 5,762,565 | 6/1998 | Milam et al. | 473/271 |
| 5,830,079 | 11/1998 | Hudson | 473/452 X |

*Primary Examiner*—George J. Marlo

*Attorney, Agent, or Firm*—Pitts & Brittian, P.C.

[57] ABSTRACT

A golf swing training device for developing the memory of a proper golf swing for every golf club a golfer uses in their game so that each swing is naturally and consistently repeated when they engage in actual play. The golf swing training device includes a base for receiving a golfer's front foot, at least one pivot arm having a first end pivotally mounted to the base and a second end opposite the first end, a biasing means for biasing the pivot arm to a first position with respect to vertical, and an engagement member disposed on the second end of the pivot arm for engaging the golfer's hip area when they position their front foot on the base to address the golf ball. Engagement of the engagement member displaces the pivot arm to a second position with respect to vertical and creates a constant pressure force against the golfer's hip area which ingrains the golfer's mind with the memory of the proper pace and body position for performing each golf swing. The biasing means automatically resets the golf swing training device to optimize repetition of the swing process and development of the swing memory. The golf swing trainer trains the golfer's swing memory for the full range of golf clubs used in a golfer's game, including driving, chipping and putting.

18 Claims, 6 Drawing Sheets

GOLF SWING TRAINING DEVICE AND METHOD

This application in part discloses and claims subject matter disclosed in my earlier filed pending application, Ser. No. 08/866,977, filed on Jun. 2, 1997 now abandoned.

TECHNICAL FIELD

This invention relates to the field of sports and to training aids which assist athletes in developing a muscle memory for performing a particular movement in a given sport such that the movement is naturally and consistently repeated when competing in that sport. More particularly, this invention relates to a golf swing training device which aids a golfer in developing a golf swing memory for each swing in their golf game such that they can naturally and consistently repeat any swing desired when actually playing golf.

BACKGROUND ART

A well-known and often used adage of life is that "practice makes perfect". In the field of sports, the game of golf offers no exception to this rule. To the contrary, as many golf enthusiasts acknowledge, it takes even more practice to succeed in golf than in many other types of sports. This sentiment results as much from the challenge of successfully striking a golf ball with a golf club as it does from trying to remember all of the steps the golfer is taught, and the proper sequence for completing those steps, to successfully strike the ball.

The game of golf comprehends a number of different types of club swings, including driving, chipping and putting. Proper execution of the swing for each club requires the specific recollection of a separate sequence of steps. For example, in driving a golf ball, a golfer is typically instructed to keep their feet approximately shoulder width apart, back straight, knees flexed, elbows in, and head down during setup; to keep their head still as they rotate the shoulders, shift their weight to their back foot and bend their arms only slightly, if at all, at the elbow as they draw the club back to the top-of-swing position; and to transfer their weight to their forward leg, rotate their hips and follow through as they strike the golf ball and complete their swing. Some golfers are able to perform this and any golf swing competently from the outset. Other golfers are challenged at the outset but can achieve success at least in one phase of their game. For a handful of others, however, the challenge of coordinating these efforts for each of the different strokes in golf is so completely overwhelming that they give up the game without ever having had a real chance to master it.

Advocates of the game have produced a number of devices to assist the golfer in overcoming the difficulties they encounter in their golf game and further encourage the popularity and playability of the sport. Several of these devices have been developed particularly to help the golfer focus on perfecting their golf swing. Typical of the art are those devices disclosed in the following U.S. patents:

| Pat. No. | Inventor(s) | Issue Date |
|---|---|---|
| 5,288,074 | R. S. Scheurer | Feb. 22, 1994 |
| 5,591,090 | D. Kauffman, jr. | Jan. 7, 1997 |
| 5,672,115 | R. D. Sanchez, et al. | Sep. 30, 1997 |
| 5,762,565 | J. D. Milam, et al. | Jun. 9, 1998 |

The '074 patent issued to Scheurer discloses a device for improving a golfer's swing by restricting the motion of their hips with relation to their shoulders, thereby increasing the differential angle between their shoulder rotation and hip-turn. The Scheurer device provides a support affixed on one end to a flat base and a contoured member positioned on the support end opposite the base to receive the hips of the golfer and pivot along a defined horizontal plane to limit the movement of the golfer's hips during a golf swing. The '090 patent issued to Kauffman discloses a device which controls hip movement during a golf swing by providing a stand mounted knee support for receiving the knee of the rear leg of the golfer as they practice their swing. The '115 patent issued to Sanchez, et al., discloses a device which includes a waist tether and a tee platform that cooperatively correct a golfer's swing by providing audio and visual feedback when their movement exceeds fixed parameters. The '565 patent issued to Milam describes a training device which teaches a proper golf swing by measuring the golfer's hip movement during the swing process. The Milam device includes a base which is contoured to receive the heel of a golfer's lead foot and a stand pivotally attached to the base. The base includes a contact point for the golfer's hips and an indicator positioned near the base for noting the degree of displacement of the stand caused by the golfer's hip as the golfer performs their golf swing.

None of the devices in the art discloses a golf swing training device which moves with the golfer throughout their golf swing to make them aware of their body position at each point of their swing. Nor do any devices in the art provide a golf swing trainer which is laterally displaceable to enable the golfer to practice a full range of each of their golf swings. None of the devices in the art disclose a golf swing trainer which is retractable to enable the golfer to repeat their golf swing quickly and easily to develop their golf swing memory. Nor do any of the devices enable the golfer to practice each of the different swings in their golf game, including driving, chipping, and putting. Moreover, several of the devices in the art are ineffective memory trainers as they rely on reenforcement mechanisms, such as audio and/or visual signals, which are unavailable to the golfer when they actually engage in a game of golf. To the extent that the golfer is trained to rely on such mechanisms to effectively perform their swing, and they are unavailable on a golf course, training by means of such devices will likely impede their progress and performance.

Therefore, it is an object of this invention to enable a golfer to better their golf swing by using a device that heightens their awareness of their body position and movement throughout their golf swing.

It is also an object of this invention is to provide a golf swing trainer that assists the golfer in properly aligning their body with respect to the golf ball during address, assists them in controlling their hip movement on take away and in initiation of their swing, and assists them in controlling their head movement throughout the swing process.

Another object of this invention to provide a golfer with a swing training device in which provides a constant memory shaping feedback with a minimum of distraction.

A further object of this invention is to provide a golf swing trainer which allows a golfer to train their swing memory for each style of swing in their golf game, including driving, chipping and putting, using a single swing training device.

Yet another object of this invention is to provide a golf swing trainer which automatically resets and permits the golfer to repeat their golf swing without interruption.

Moreover, it is an object of this invention to provide a golf swing trainer which permits the golfer to enjoy an unimpeded full range of motion during the practice of a golf swing such that a realistic golf swing memory is created.

DISCLOSURE OF THE INVENTION

Other objects and advantages will be accomplished by the present invention which enables a golfer to develop a memory of every golf swing in their golf game such that any swing is naturally and consistently repeated when playing the game of golf. The golf swing training device includes a base providing an area for placement of a golfer's front foot, at least one pivot arm having a first end pivotally mounted to the base and a second end opposite the first end, a biasing means for providing a biasing force to the pivot arm, and an engagement member disposed on the second end of the pivot arm for engaging the hip area of the golfer. The biasing member biases the pivot arm in a first position such that the golfer's hip area comes into contact with the engagement member as they set-up and initially address the golf ball. The interaction between the engagement member and the golfer's hip during set-up displaces the engagement member to tension the biasing member. The tension in the biasing member is translated through the engagement member as a resistive force or counter-pressure which is applied to the golfer's hip area and initiates the training of the swing memory. The counter-pressure is continually applied to the hip area as the golfer moves from this first position throughout the golf swing to a second position defined by the follow-through and completion of their swing. The counter-pressure applied to the golfer's hip area provides them with a mental impression of the appropriate physical pace for the movement of their body during the performance of a golf swing such that the swing is consistently repeated when they engage in actual play. The biasing means permits or causes the automatic resetting of the trainer such that repetition of the process is facilitated and the potential for development of the swing memory is optimized. The training action of the golf swing trainer enables training of the full range of golf swings, including driving, chipping and putting.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A golf swing training device incorporating various features of the present invention is illustrated generally at 10 in the figures. The golf swing training device 10 aids golfers in developing a golf swing memory such that they can naturally and consistently repeat any one of the full range of their golf swings when actually playing the game on a golf course. The swing trainer 10 creates a swing memory by providing an engagement arm 50 which is biased toward the golfer's hip area to produce a constant force against the hip area throughout their swing and is automatically re-set each time they set-up to perform their swing. The golf swing training device 10 assists in correcting the vertical alignment of the golfer in addressing the golf ball and eliminates excess movement in the golfer's hips when they draw the golf club back and when they initiate their golf swing. An added benefit in correcting vertical alignment and eliminating excess hip movement is that the golf swing training device 10 also assists in controlling excess movement of the golfer's head when engaging in a golf swing.

Figure 1:
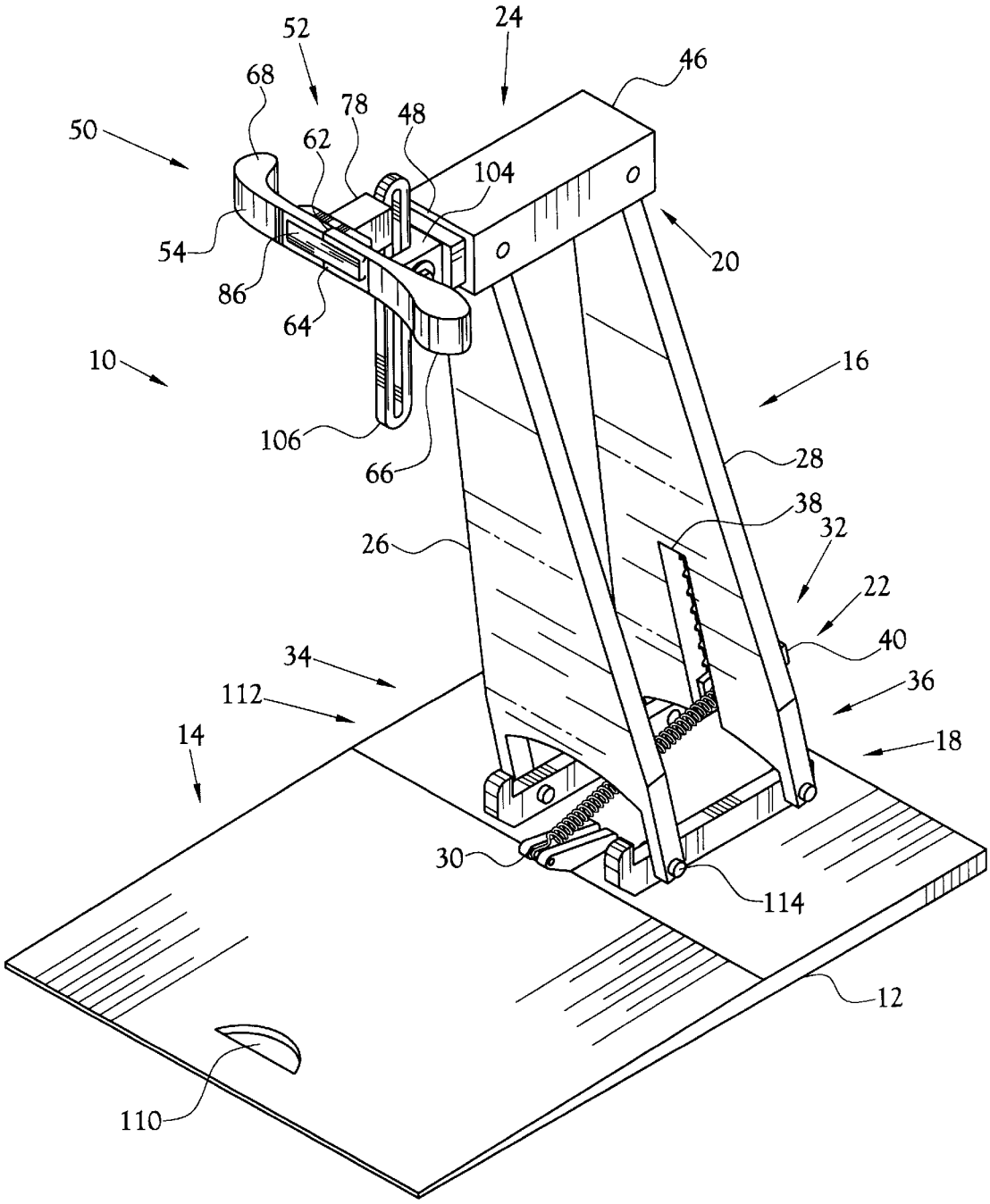
FIG. 1 is a perspective view of the golf swing training device constructed in accordance with several features of the present invention.
Figure 2:
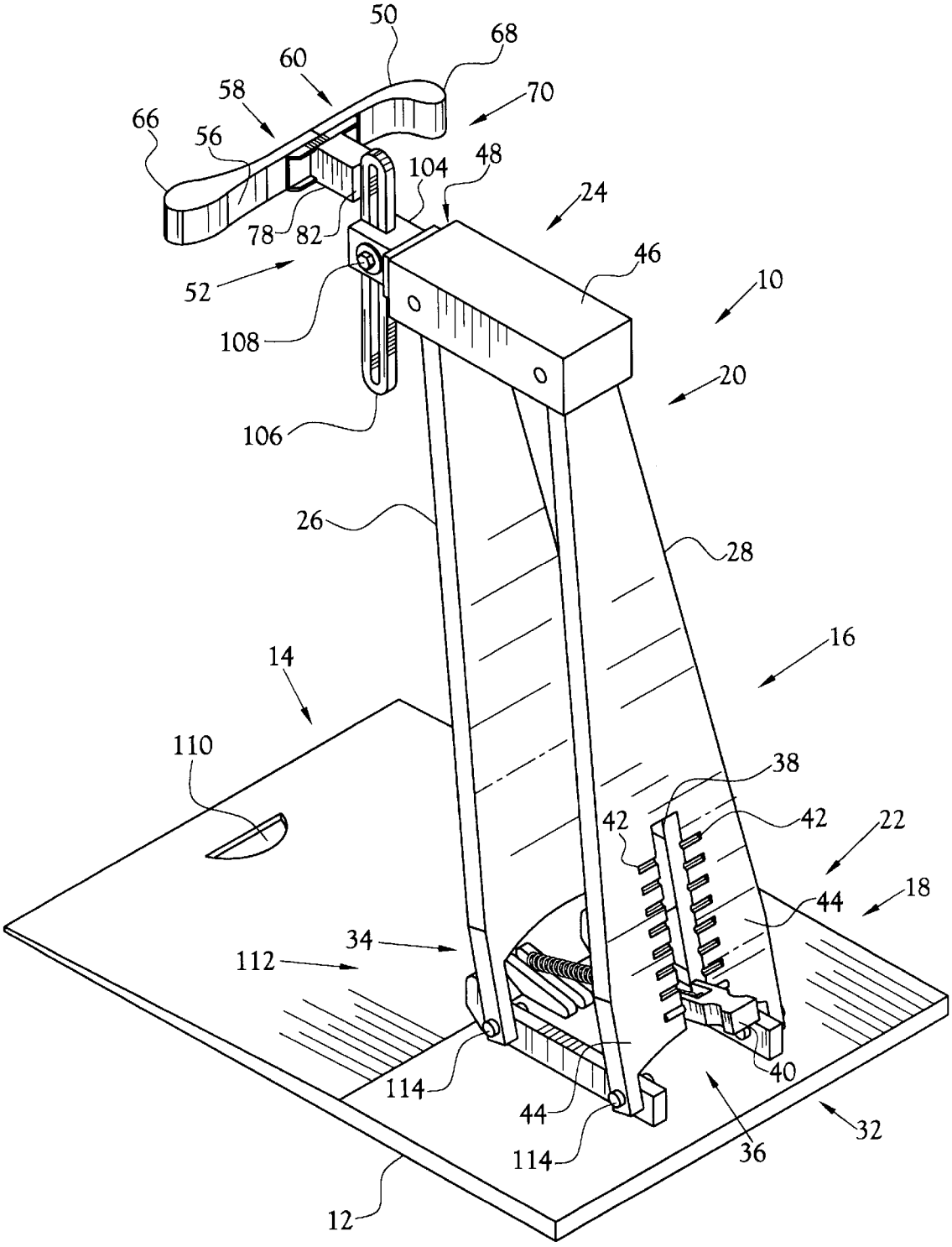
FIG. 2 illustrates a second perspective view of the present invention.

As illustrated in FIGS. 1 and 2, the golf swing training device 10 includes a base 12 providing an area 14 for placement of a golfer's front foot, at least one pivot arm 16 having a first end 18 pivotally mounted to the base 12 and a second end 20 opposite the first end 18, a pivot arm biasing means 22 for biasing the pivot arm 16 in a first position with respect to vertical, and an engagement member 24 disposed on the second end 20 of the pivot arm 16 for engaging the hip area of the golfer as they set-up and initially address the golf ball. Movement of the golfer's hip area during a golf swing displaces the pivot arm 16 to a second position with respect to vertical upon the completion of their swing. The change in biasing force which is translated to the golfer's hip throughout the golf swing provides the golfer with a golf swing memory. Repetition of this movement produces a golf swing memory which is successfully and consistently reproduced whenever the golfer actually engages in the game of golf. As desired, the golfer may selectively employ the golf swing trainer 10 to work on any or every facet of their game from driving to chipping to putting. To facilitate the following discussion, reference is made to training a swing memory for driving a golf ball. It will be understood, nonetheless, that the golf swing training device 10 is similarly adaptable for training the full range of golf swings in a golfer's game.

In the preferred embodiment illustrated in FIGS. 1 and 2, the area 14 of the base 12 which receives the golfer's front foot is sloped to provide the golfer with additional memory shaping assistance. As those skilled in the art will recognize, when a golfer draws their golf club back to the top-of-the-back swing position, the knee of their front leg moves laterally and rearward according to the rotation of their shoulders. Proper development of a golfer's sense of knee position with relation to their front foot insures proper rotation of the golfer's hips during the down swing and the transfer of their weight to their front foot, thus enabling them to aggressively unwind their hips and shoulders as they stroke the golf ball. The sloped area 14 enables the golfer to preset their front foot while practicing their golf swing. It also enables them to develop a sense of the proper lower body stance they should have in the top-of-back swing position.

As also illustrated in FIGS. 1 and 2, the pivot arm 16 of the preferred embodiment includes a first and a second pivot arm member 26, 28, each of which is pivotally mounted to the engagement member 24 so that the movement of the engagement member 24 with respect to the base 12 is pantographic. The pantographic movement of the pivot arm 16 is preferable as a method of training as it enables the lateral movement of engagement member 24 with respect to the golfer's hip throughout the entire range of motion of the golf swing. The pantographic movement of the pivot arm 16 insures the uniform application of memory developing pressure to the golfer's hip area throughout the golf swing process. Such movement and constant pressure provides the golfer with ongoing mental reenforcement of their body position and makes them aware of whether their hips is move too far back during take-away or too far forward during their down-swing. The pantographic movement of the pivot arm 16 also eliminates any distraction that the golfer may feel in the variation of the area or extent of pressure applied to the golfer's hip as they train their swing memory. Though other pivot arms 16 are adaptable to extend between the base 12 and the engagement member 24 of a golf swing training device 10, and interact with the pivot arm biasing means 22 to translate a biasing force to the golfer's hip area, none provide the benefits afforded by the pivot arm 16 of the present invention. Other embodiments of a pivot arm 16 defining pantographic movement are equally foreseeable.

As shown in FIG. 1, the pivot arm biasing means 22 of the preferred embodiment is disposed between the base 12 and the pivot arm 16 to bias the pivot arm 16 and engagement member 24 toward the golfer's hip area throughout their golf swing. The pivot arm biasing means 22 includes a first end 30 secured to the base 12 and a second end 32 received in an adapter 40. The pivot arm biasing means extends through openings 34, 36 defined by pivot arm members 24, 26. As shown in the figures, openings 34, 36 are arched, or arcuate. Other acceptable opening configurations are equally foreseeable.

As more particularly illustrated in FIG. 2, pivot arm member 28 further includes a vertical slot 38 which extends upward from opening 36 and a plurality of paired grooves 42 which are evenly spaced and disposed, one each of each pair, on opposed sides 44 of the vertical slot 38 for removably receiving the adapter 40. Displacement of the adapter 40 from one pair grooves 42 to another enables the adjustment of the pivot arm biasing means 22 and variation in biasing pressure to provide a desired tension level. The pivot arm biasing means 22 illustrated in the figures is a spring, such as a coil spring. An elastomeric pivot arm biasing means 22 such as a rubber band is also preferable. Still other embodiments of the pivot arm biasing means 22 are equally foreseeable.

The engagement member 24 engages the golfer's hip area and translates the pressure defined by the pivot arm biasing means 22 to the golfer's hip area to develop and re-enforce the training of the golfer's swing memory. The golfer's hip area is understood to include that area of the side of the golfer's body proximate the hip and the waistline. As illustrated in FIGS. 1 and 2, the engagement member 24 includes a housing 46 having a front end 48 facing the hip area of the golfer, an engagement arm 50, and an adjustment mechanism 52 disposed between the front end 48 of the housing 46 and the engagement arm 50 for vertically adjusting the position of the engagement arm 50 relative to the golfer's hip area. The housing 46 is received on the second end 20 of the pivot arm 16.

Figure 3:
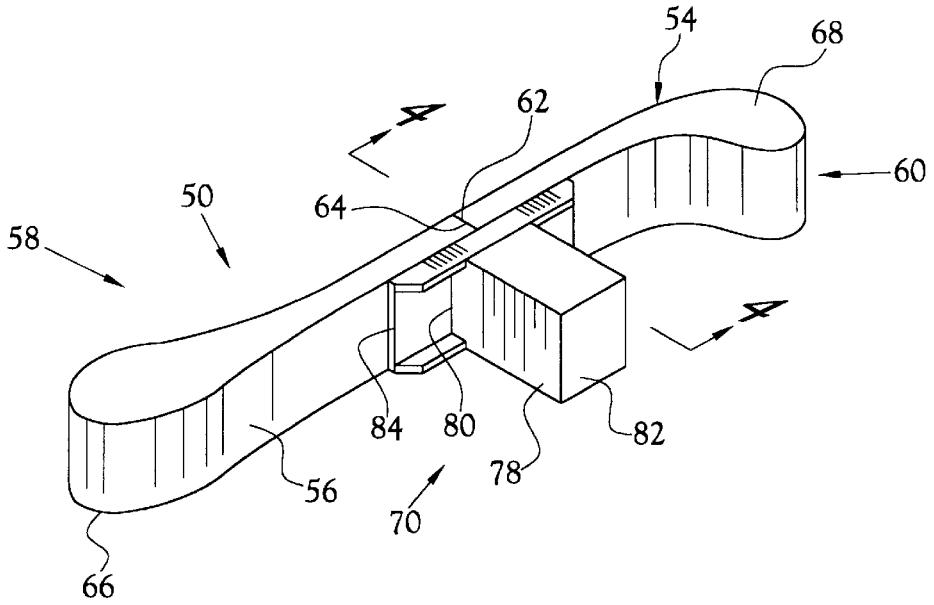
FIG. 3 is a perspective view of the engagement member of the golf swing training device.

The preferred embodiment of the engagement arm 50 is shown in FIG. 3. In this embodiment, the engagement arm 50 includes a front side 54, a back side 56 and two ends 58, 60 which are horizontally separable to accommodate the width of the golfer's hip area. Each end 58, 60 defines a medial border 62, 64 and a lateral curve 66, 68 which extends, one in an opposite direction from the other. The medial borders 62, 64 of each end 58, 60 of the engagement arm 50 contact each other when the arm 50 is in a closed or retracted position. Engagement arm end 58 preferably defines a longer lateral curve 66 which extends away from the pivot arm 16 and supports the rear of the golfer's hip area. Engagement arm end 60 preferably defines a shorter lateral curve 68 which extends toward the pivot arm 16 and away from the front of the golfer's hip. The dimension and curvature direction of arm ends 66, 68 are such that they do not impede the golfer's full range of motion when in their stance and performing their golf swing.

Figure 4:
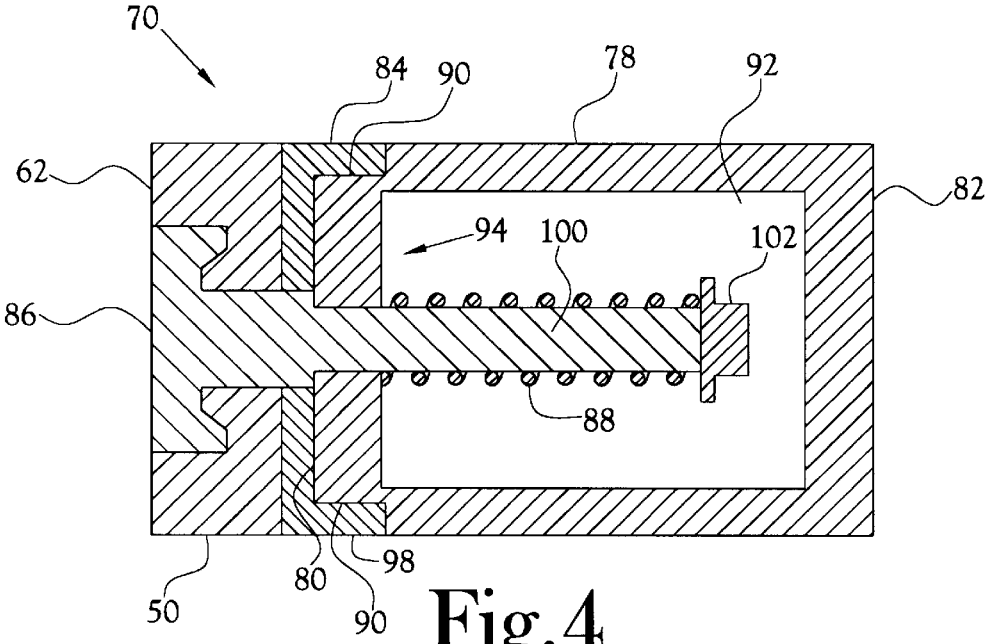
FIG. 4 illustrates a side elevation view, in section, of the engagement member of the present invention taken at 4—4 of FIG. 3.

In the preferred embodiment, the engagement arm 50 further includes a stabilizer 70 for stabilizing the position of the engagement arm 50 within the engagement member 24. As shown in FIG. 4, the stabilizer 70 includes a stabilizer base 78 having a front face 80 and a rear face 82, a base plate 84 received on the front face 80 of the stabilizer base 78, a face plate 86 positioned against the front side 54 of the engagement arm 50 and a stabilizer biasing member 88 for cooperatively biasing the face plate 86 toward the base plate 84 and stabilizing the engagement arm 50. The front face 80 of the stabilizer base 78 includes a pair of opposed grooves 90 for seating the base plate 84 and an interior cavity 92 for receiving the stabilizer biasing member 88. The rear face 82 of the stabilizer base 78 is positioned on adjustment mechanism 52. The base plate 84 includes a central opening 94 and four stabilizing plate posts 96 disposed, one each, on each corner 98 of the base plate 84.

Figure 5:
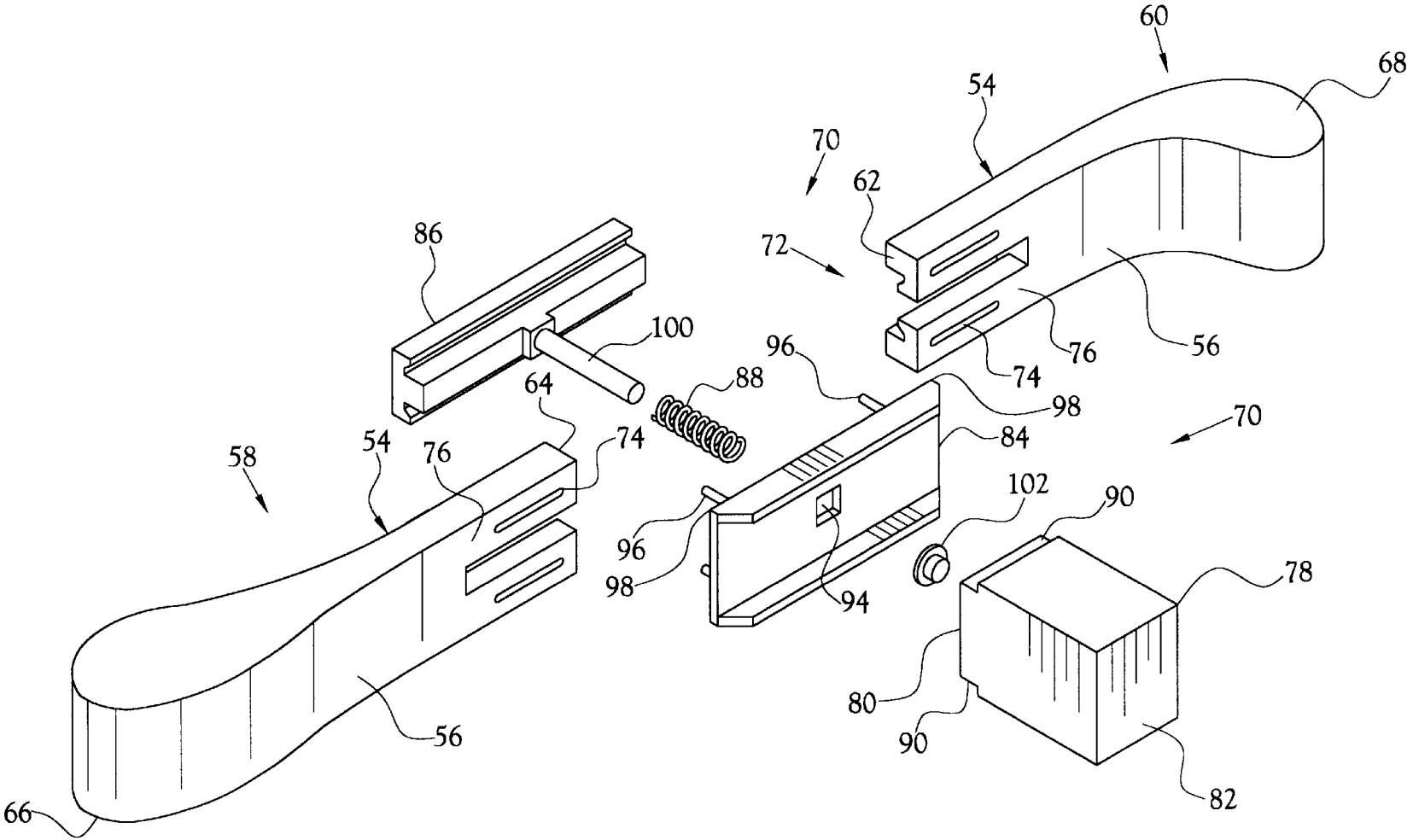
FIG. 5 is an exploded view of the engagement member of the golf swing training device present invention.

As illustrated in FIG. 5, the face plate 86 preferably defines a T-shaped configuration and includes an extension arm 100 extending rearward therefrom, the front side 54 of each end 58, 60 of the engagement arm 50 further includes a face plate slot 72 which has a T-shaped impression for receiving the T-shaped face plate 86, and the back side 56 further includes two pair of stabilizer plate post receptors 74 disposed, one pair each, on opposed sides 76 of the face plate slot 72. A portion of the face plate slot extends laterally from each of the medial border 62, 64 of each engagement arm end 58, 60, The stabilizing plate posts 96 of the base plate 84 are received in and cooperate with the stabilizer plate post receptors 74 to delimit the slidable movement of each end 56, 58 of the arm 50 in the stabilizer 70. The extensor arm 100 extends between the medial borders 62, 64 of the engagement arm 50, through the central opening 94 of the base plate 84 and is received within the stabilizer biasing member 88 in the interior cavity 92 of the stabilizer base 78. The extensor arm 100 further includes an extensor arm end cap 102 for securely positioning of the stabilizer biasing member 88 about the extensor arm 100 within the base 78. The stabilizer biasing member 88 enables its rotation within the housing 46 such that the engagement member 24 is adjustable to accommodate both right-handed and left-handed golfers, equally. The rotatability of the stabilizer biasing member 88 within the housing 46 enhances the portability of the golf swing training device 10 as described in greater detail below. As illustrated in the figures, the stabilizer biasing member 88 is a coil spring. Other stabilizing biasing members 88 are foreseeable.

As also seen in the figures, the adjustment mechanism 52 includes an adjustment bracket base 104 which is positioned on the front end 48 of the housing 46 and an adjustment bracket 106 movably received in the adjustment bracket base 104 for enabling vertical displacement of the engagement arm 50. The adjustment bracket base 104 of the preferred embodiment includes a nut-and-bolt assembly 108 for selectively enabling the movement of the adjustment bracket 106 in the base 104 and the secure seating of the bracket 106 in a desired position once it has been determined. As those skilled in the art will recognize, other adjustment mechanisms 52 are equally adaptable for achieving the adjustment objectives described herein.

As those skilled in the art will readily realize, in view of the embodiments shown in the figures and now understanding the present invention, the pivot arm 16 of the golf swing trainer 10 is preferably separable from the base 12 such that the swing trainer 10 is portable. As illustrated in the figures, the portability of the swing trainer 10 is accomplished by providing the base 12 with a handle 110 and means 112 for separating the pivot arm 16 from the base 12 so that the pivot arm 16 is associated with the base and the golf swing trainer 10 is carried by the handle 110. One means 112 for detaching the pivot arm 16 from the base 12 is provided by removal of the pins 114 which pivotally secure the pivot arm to the base, as shown. Another means, not shown, is to provide that the pivot arm 16 is pivotally secured to a detachable portion of the base 12 and that the base 12 further includes a securement mechanism for securing its detachable portion to the base 12 while the golf swing trainer 10 is in use. Still other methods for providing portability to the swing trainer are foreseeable, as well.

The ease in set-up and use of the golf swing training device 10 facilitates the development of a good golf swing memory. The first time a golfer uses the golf swing trainer 10 they will need to make several adjustments, including setting the desired tension of the pivot arm biasing means 22 and adjusting the disposition of the engagement member 24. Pivot arm tension is set by standing behind the swing trainer 10 and manipulating the adapter 40 to either a higher or a lower position among the paired grooves 42 to increase or decrease the biasing force provided by the pivot arm biasing means 22, respectively. The engagement arm 50 is adjusted by rotating the arm 50 and the stabilizer 70 to accommodate the handedness of the golfer. The height of the engagement arm 50 is also adjusted when the golfer places their front foot on the sloped surface of the base 12, engages the engagement arm 50, and measures their hip position vis-a-vis the arm 50. The height adjustment is completed when the golfer loosens the nut-and-bolt assembly 108 and vertically adjusts the bracket 106 so that their hip area is in communication with the engagement arm 50. Once fixed, these settings will remained fixed so long as desired. Moreover, as the golfer will find, these settings are easily changed simply by repeating these same steps.

Figure 6C:
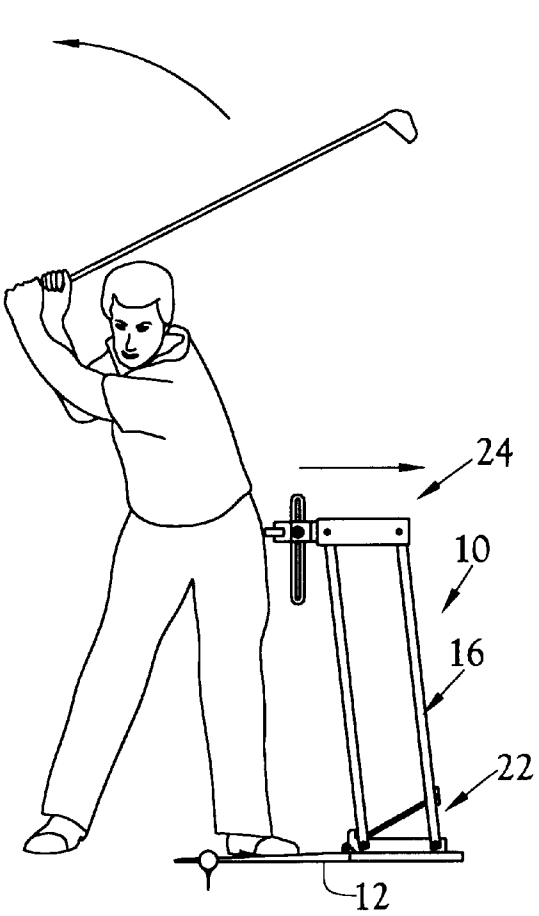
FIGS. 6*a*–6*e* illustrate a series of side elevation views of the present invention shown in use during different stages of a golf swing.
Figure 6B:
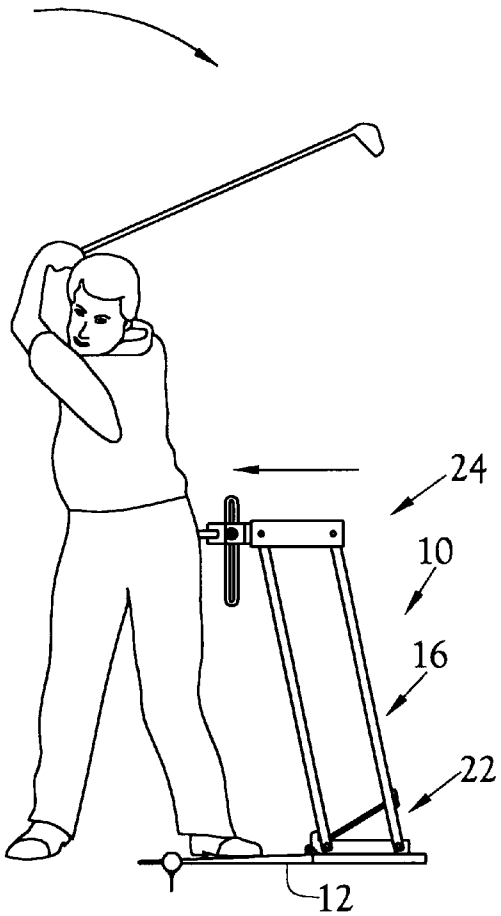
Figure 6A:
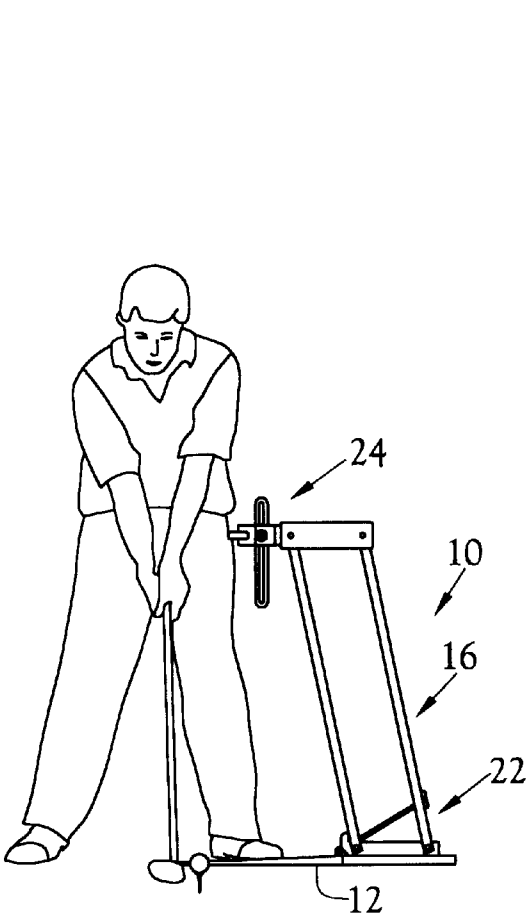
Figure 6E:
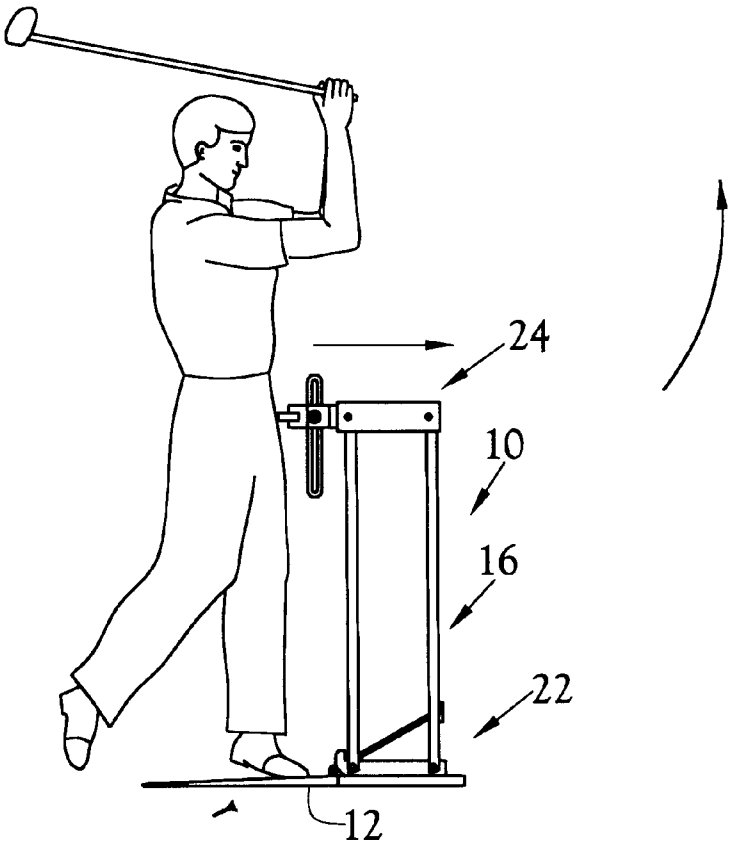
Figure 6D:
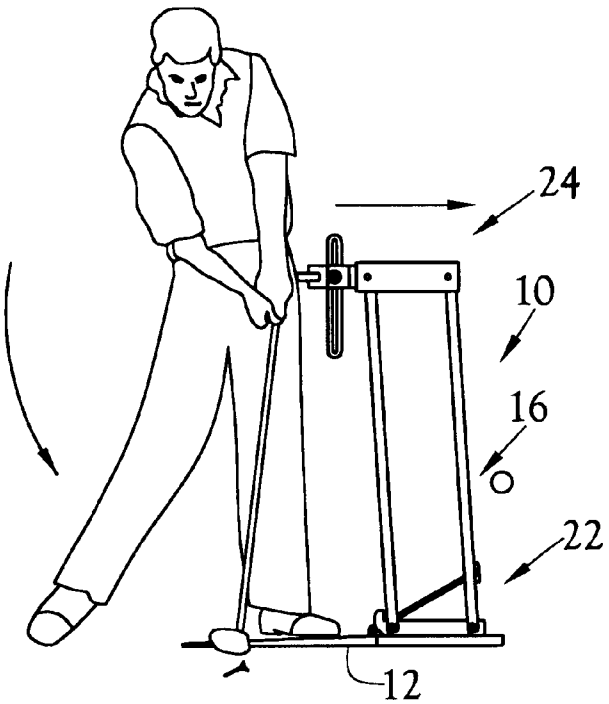

The method for using the golf swing trainer 10 is best illustrated in the series of elevation views shown in FIGS. 6*a*–6*e*. Taking a golf club in hand and establishes their golf grip, the golfer steps onto the sloped surface of the base 12 and sets their front foot such that their front hip engages and tensions the pivot arm biasing means 22 as if they were stepping into a tee box or addressing a ball on the fairway. As shown in FIG. 6*a,* engagement of the biasing means 22 sets up an initial biasing force which is translated to the golfer's hip through the pivot arm 16 and initiates the training of their swing memory. The golfer then draws their golf club back to the top-of-the-back swing position by turning their shoulders until the front shoulder socket is even with the rear hip, their rear elbow is bent and their wrists are cocked. As shown in FIG. 6*b,* the pivot arm biasing means 22 continues to provide pressure to the hip area of the golfer and establishes a second point of swing memory. As the golfer begins their golf swing, they drop their rear shoulder toward their rear hip and unwind their hips and shoulders to drive the golf ball. As shown in FIGS. 6*c*–6*d,* the swing trainer 10 moves with the golfer throughout the swing process, applying continued pressure against their hip to further train the swing memory until the swing is completed. At the point of completion, as shown in FIG. 6*e,* the golfer has displaced the engagement member 24 to a final position with respect to vertical and been provided with a further memory of proper hip position for the completion of their golf swing. As the golfer's mind takes stock of the collective impressions embedded by use of the swing trainer, and the success of their stroke, they repeat the swing process to reenforce these impressions and an effective swing memory is created. As described above, those skilled in the art will also recognize how the golf swing trainer 10 is adaptable to assist the golfer in training his swing memory for other golf strokes as well, including chipping and putting.

From the foregoing description, it will be recognized by those skilled in the art that a golf swing training device offering advantages over the prior art has been provided. Specifically, the training device enables a golfer to better their golf swing by providing a constant pressure which heightens their awareness of their body position and movement throughout their golf swing. Memory shaping feedback is provided with minimal distraction and in a manner which is both realistic and easily reproduced on a golf course. Set-up is taught by presetting their lead foot and, consequently, their lower body with relation to their swing position. The golf swing training device automatically resets and permits the golfer to repeat their golf swing without interruption. It enables the golfer to train their swing memory for every golf club used in playing their golf game from driving to putting. Moreover, the engagement arm is configured to permit the golfer to enjoy an unimpeded full range of motion during the practice of their golf swing such that a realistic swing memory is created. While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A golf swing training device for practicing a proper golf swing and training the golfer's memory to recreate that swing while playing a game of golf, said golf swing training device comprising:

a base providing a support surface for placement of a golfer's front foot and for pivotally mounting a pivot arm;

at least one pivot arm having a first end pivotally mounted on said base and a second end opposite said first end;

a biasing means for providing an initial biasing force for biasing said pivot arm in a first position with respect to vertical; and an engagement member positioned on said second end of said pivot arm for engaging the hip area of the golfer when the golfer's foot is placed on said base whereby movement of the golfer's hip area during a golf swing displaces said pivot arm to a second position with respect to vertical and creates a change in said initial biasing force which is translated to the golfer's hip and produces a swing memory which is reproduced when the golfer engages in the game of golf.

2. The golf swing training device of claim 1 wherein said support surface is sloped.

3. The golf swing training device of claim 1 wherein said pivot arm includes a first and a second pivot arm member, each said first and said second pivot arm member having a first end pivotally mounted to said base and a second end pivotally secured to said engagement member such that movement of said engagement member with respect to said base member is pantographic.

4. The golf swing training device of claim 1 wherein said biasing means is adjustably disposed between said base and said pivot arm for providing variable degrees of biasing force to bias said pivot arm in said first position with respect to vertical and throughout the golfer's golf swing to said second position with respect to vertical.

5. The golf swing training device of claim 4 wherein said biasing means is elastomeric.

6. The golf swing training device of claim 4 wherein said biasing means is a spring.

7. The golf swing training device of claim 1 wherein said engagement member includes a housing having a front end facing the hip area of the golfer, an engagement arm and an adjustment mechanism disposed between said front end of said housing and said engagement arm for vertically adjusting the position of said engagement arm relative to the height of an individual's hip area.

8. The engagement member of claim 7 wherein said engagement arm defines two ends which are horizontally separable to accommodate the width of a golfer's hip area and said engagement arm includes a stabilizer for stabilizing and delimiting the separation of said ends of said engagement arm, said engagement arm defining a front side and a back side, said stabilizer including a stabilizer base extending from said adjustment mechanism, a base plate positioned between said back side of said engagement arm and said stabilizer base, a face plate positioned against said front side of said engagement arm, said face plate including an extensor arm extending between said two ends of said engagement arm and through said base plate, and a biasing means disposed in said stabilizer base for receiving said extensor arm and biasing said ends of said engagement arm between said base plate and said face plate.

9. The engagement member of claim 7 wherein said adjustment mechanism includes an adjustment bracket base positioned on said front end of said housing and an adjustment bracket movably received in said adjustment bracket base for enabling said vertical adjustment of said engagement arm, said stabilizer of said engagement member being mounted on said adjustment bracket.

10. A method for developing a golf swing memory using a golf swing training comprising:

locating said golf swing trainer in a environment that permits the full range of motion incident a typical golf swing, said golf swing trainer including a base providing a support surface for placement of the front foot of a golfer, at least one pivot arm having a first end pivotally mounted on said base and a second end opposite said first end, a biasing means for providing an initial biasing force that biases said pivot arm in a first position with respect to vertical, and an engagement member positioned on said second end of said pivot arm for engaging the hip area of the golfer when the golfer's foot is placed on said base;

preliminarily assuming a golf stance in said swing trainer to adjust the position of said engagement member with respect to the height and dimension of the hip area of the golfer;

taking a golf club in hand and establishing a golf grip thereon;

tensioning said biasing member by positioning the golfer's front foot on said support surface such that their hip area engages said engagement member and assuming a proper golf stance, said initial biasing force being translated through said pivot arm to the golfer's hip to provide the golfer with a feeling of pressure which initiates the creation of a swing memory;

visualizing and addressing a golf ball as if in a tee box or on a fairway;

performing a proper golf swing wherein movement of the golfer's hip area during the golf swing displaces said pivot arm to a second position with respect to vertical and creates a change in said initial biasing force which is further translated to the golfer's hip area to further development of the golfer's swing memory;

mentally noting the changes in biasing force felt by the golfer throughout performance of their golf swing; and repeating each action to produce a comprehensive golf swing memory which is consistently repeatable when the golfer engages in a game of golf.

11. The method of claim 10 wherein said pivot arm of said golf swing training device includes a first and a second pivot arm member, each said first and said second pivot arm member having a first end pivotally mounted to said base and a second end for pivotally secured to said engagement member such that movement of said engagement member with respect to said base member is pantographic.

12. The method claim 10 wherein said biasing means of said golf swing training device is adjustably disposed between said base and said pivot arm for providing variable degrees of said biasing force to bias said pivot arm in said first position with respect to vertical and throughout the golfer's swing to said second position with respect to vertical.

13. The method of claim 12 wherein said biasing means of said golf swing training device is elastomeric.

14. The method of claim 12 wherein said biasing means of said golf swing training device is a spring.

15. The method of claim 10 wherein said engagement member of said golf swing training deice includes a housing having a front end facing the hip area of the golfer, an engagement arm and an adjustment mechanism disposed between said front end of said housing and said engagement arm for vertically adjusting the position of the engagement arm relative to the height of an individual's hip area.

16. The method of claim 15 wherein said engagement arm defines two ends which are horizontally separable to accommodate the width of a golfer's hip area and said engagement arm includes a stabilizer for stabilizing and delimiting the separation of said ends of said engagement arm, said engagement arm defining a front side and a back side, said stabilizer including a stabilizer base extending from said adjustment mechanism, a base plate positioned between said back side of said engagement arm and said stabilizer base, a face plate positioned against said front side of said engagement arm, said face plate including an extensor arm extending between said two ends of said engagement arm and through said base plate, and a biasing means disposed in said stabilizer base for receiving said extensor arm and biasing said ends of said engagement arm between said base plate and said face plate.

17. The engagement member of claim 15 wherein said adjustment mechanism includes an adjustment bracket base positioned on said front end of said housing and an adjustment bracket movably received in said adjustment bracket base for enabling said vertical adjustment of said engagement arm, said stabilizer of said engagement member being mounted on said adjustment bracket.

18. A golf swing training device for practicing a proper golf swing and training the golfer's memory to recreate that swing while playing the game of golf, said golf swing training device comprising:

a base providing a sloped support surface for placement of a golfer's front foot, at least one pivot arm having a first end pivotally mounted on said base and a second end opposite said first end, said pivot arm including a first and a second pivot arm member, each said first and said second arm member having a first end pivotally mounted to said base and a second end for pivotally receiving said engagement member such that movement of said engagement member with respect to said base member is pantographic;

an elastomeric biasing means for providing an initial biasing force that biases said pivot arm in a first position with respect to vertical; and an engagement member positioned on said second end of said pivot arm for engaging the hip area of the golfer when the golfer's foot is placed on said base, said engagement member including a housing having a front end facing the hip area of the golfer, an engagement arm and an adjustment mechanism disposed between said front end of said housing and said engagement arm for vertically adjusting the position of the engagement arm relative to the height of the golfer's hip area, said engagement arm defining a front side, a back side and two ends which are horizontally separable to accommodate the width of a golfer's hip area and a stabilizer for stabilizing and delimiting the separation said ends of said engagement arm, said stabilizer including a stabilizer base extending from said adjustment mechanism, a base plate positioned between said back side of said engagement arm and said stabilizer base, a face plate positioned against said front side of said engagement arm, said face plate including an extensor arm extending between said two ends of said engagement arm and through said base plate, and a biasing means disposed in said stabilizer base for receiving said extensor arm and biasing said ends of said engagement arm between said base plate and said face plate, said adjustment mechanism includes an adjustment bracket base positioned on said front end of said housing for receiving said stabilizer of said engagement arm and an adjustment bracket movably received in said adjustment bracket base for enabling vertical adjustment of said engagement arm, whereby movement of the golfer's hip area during the golf swing displaces said pivot arm to a second position with respect to vertical and creates a change in said initial biasing force which is translated to the golfer's hip and produces a swing memory which is reproduced when the golfer engages in the game of golf.

* * * * *